US005303474A

United States Patent [19]

Keklak et al.

[11] Patent Number: 5,303,474

[45] Date of Patent: Apr. 19, 1994

[54] SAFETY UTILITY KNIFE

[75] Inventors: Ronald Keklak, Ridge Spring, S.C.; Michael V. Couture, South Hadley, Mass.; John C. Whitehouse, Edgefield, S.C.

[73] Assignee: PSI, Inc., South Hadley, Mass.

[21] Appl. No.: 983,175

[22] Filed: Nov. 30, 1992

[51] Int. Cl.[5] ..... B26B 1/08

[52] U.S. Cl. ..... 30/162; 30/125; 30/335

[58] Field of Search ..... 30/125, 151, 162, 335, 30/2, 337, 336; 81/367

[56] References Cited

U.S. PATENT DOCUMENTS

| | | | |
|---|---|---|---|
| 3,448,518 | 6/1969 | Sklar | 30/162 |
| 4,277,888 | 7/1981 | Szabo | 30/162 |
| 4,683,656 | 8/1987 | Peyrot et al. | 30/162 |
| 4,713,885 | 12/1987 | Keklak et al. | 30/162 |
| 4,757,612 | 7/1988 | Peyrot | 30/151 |
| 4,761,882 | 8/1988 | Silverstein | 30/162 |
| 4,823,463 | 4/1989 | Lemaire | 30/162 |
| 4,949,458 | 8/1990 | Davis et al. | 30/162 |
| 4,953,293 | 9/1990 | Sterlacci | 30/151 |

*Primary Examiner*—Eugenia Jones
*Assistant Examiner*—Hwei-Siu Payer
*Attorney, Agent, or Firm*—Kimmel, Crowell & Weaver

[57] ABSTRACT

An improved safety utility knife has a hollow handle and a blade which is normally retracted within the handle, but can be extended by squeezing an operating lever. The lever is connected to the blade holder by a toggle linkage having a rearmost pin secured in a discrete support whose position is adjustable. A thumbscrew threaded into the support enables one to adjust the position of the support from outside the handle, and thus change how far the blade protrudes from the handle when the operating lever is fully depressed.

10 Claims, 4 Drawing Sheets

SAFETY UTILITY KNIFE

BACKGROUND OF THE INVENTION

This invention relates to a utility knife, more particularly, to a knife having a replaceable blade which is normally retracted, and extends to a cutting position only when an operating lever is squeezed.

In most utility knives, a replaceable blade is immovably fixed at one end of a handle. The blade is constantly exposed, with consequent risks of injury to people or objects nearby while the knife is not in use.

To avoid this danger, prior inventors, including the present inventor, have proposed arrangements in which the blade is retractable into a shielded position, for example within the handle. U.S. Pat. No. 4,713,885, whose disclosure is incorporated herein by reference, is particularly pertinent. The knife disclosed in that patent has a hollow handle including, at one end, a retractable holder for a standard utility knife blade. A toggle linkage is mounted between a fixed point in the handle and the blade holder. A spring normally biases the blade holder rearward, but the spring bias is overcome when one squeezes an operating lever protruding from the bottom of the handle, extending the toggle linkage which forces the blade to its exposed position.

The prior device described above does not permit one to limit the extension of the blade, other than by only partially depressing the operating lever, which is awkward. Additionally, the prior device uses a torsion spring at the trigger pivot to bias the trigger; consequently, the maximum spring force is encountered at the blade-extended position, which can be tiring. Another problem is that the prior device does not permit the device to locked, so that the lever cannot be operated.

SUMMARY OF THE INVENTION

Accordingly, an object of the invention is to provide a safety utility knife with means for limiting the extension of a blade, while affording the safety advantages found in a retractable-blade utility knife.

Another object of the invention is to provide an extensible-blade utility knife with good operating feel.

A further object is to enable one to store spare blades in an extensible-blade utility knife.

Yet another object is to provide an extensible and self-retracting utility knife in which application of a very small force suffices to keep the blade extended.

These and other objects are attained by an improved safety utility knife, generally of the type shown in U.S. Pat. Nos. 4,713,885, and comprising the improvement wherein the rearmost pin of the toggle linkage is held in a discrete support, rather than being fixed directly to the handle. This support is contained within the housing, but its position is adjustable. A thumbscrew is provided to enable one to adjust the position of the support from outside the handle, and thus change how far the blade protrudes from the handle when the operating lever is fully depressed.

The toggle link support position may be adjusted fore and aft by moving the thumbscrew, even to the point of preventing any extension of the blade out of the knife. Nevertheless, as a further safety precaution, there is also a positive safety which locks the blade directly, and prevents blade extension regardless of the thumbscrew adjustment.

The return spring is placed on the toggle linkage, rather than on the operating lever, so that the trigger resistance is a decreasing function of blade extension.

BRIEF DESCRIPTION OF THE DRAWINGS

In the accompanying drawings.

DESCRIPTION OF THE PREFERRED EMBODIMENT

Figure 1:
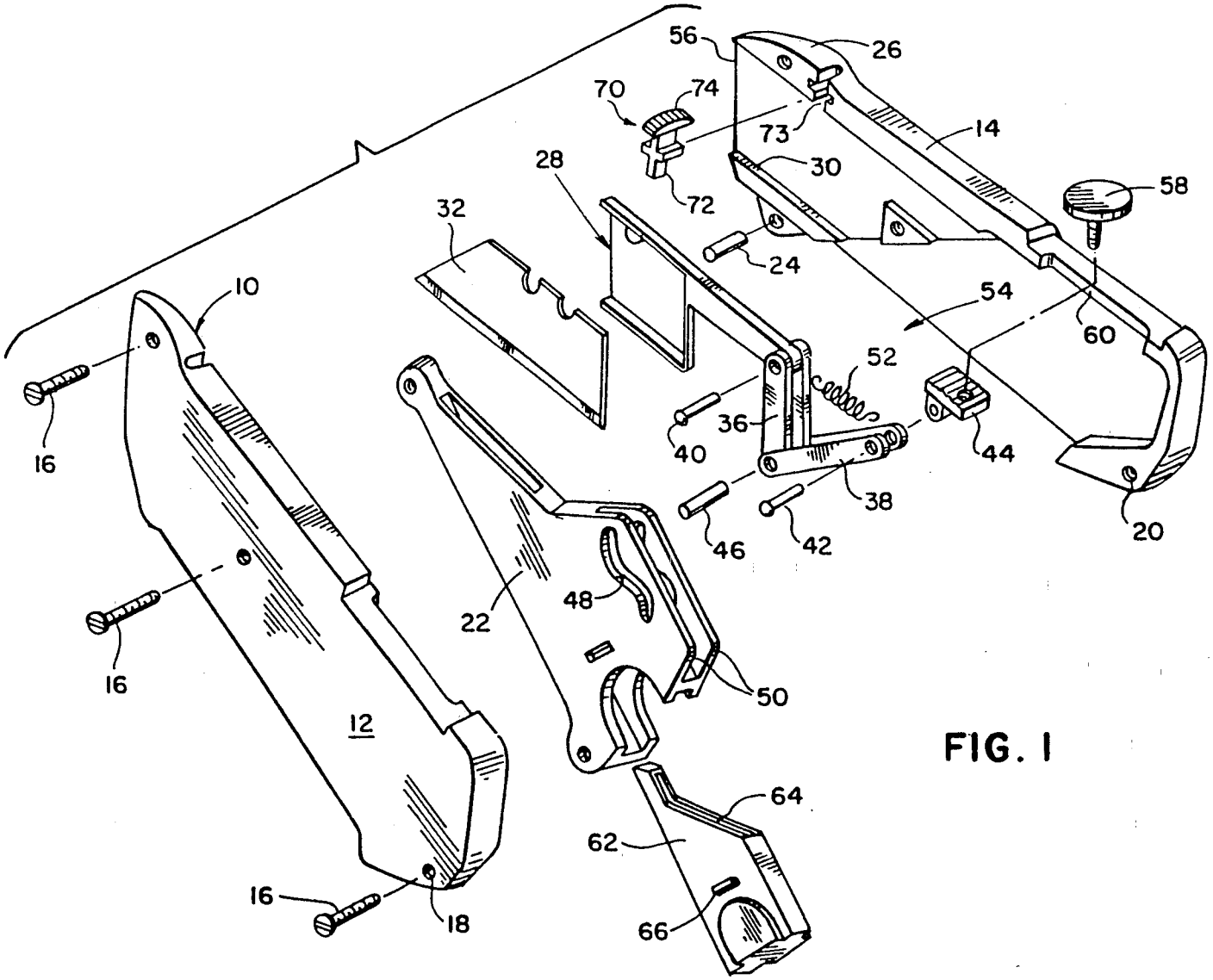
FIG. 1 is an exploded perspective view, from the left side, for a utility knife embodying the invention.
Figure 6:
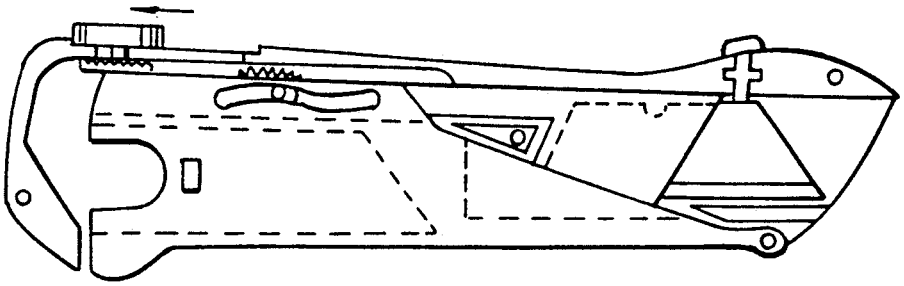
FIG. 6 is a view corresponding to FIG. 5, but with the toggle link support adjusted fully rearward so that the blade is not extended, even though the lever is depressed.
Figure 5:
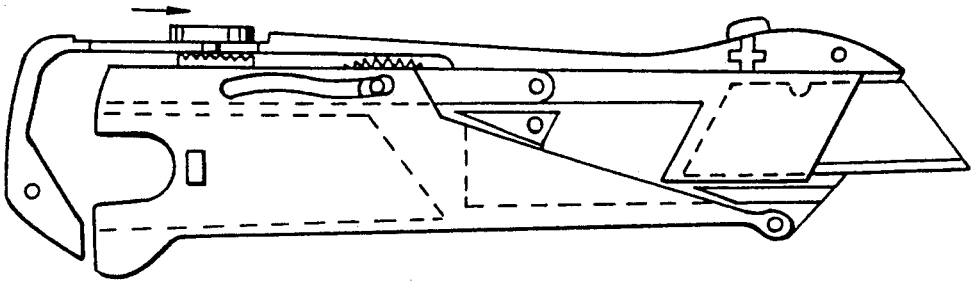
FIG. 5 is a view corresponding to FIG. 2, with the operating lever fully depressed and the blade extended.
Figure 2:
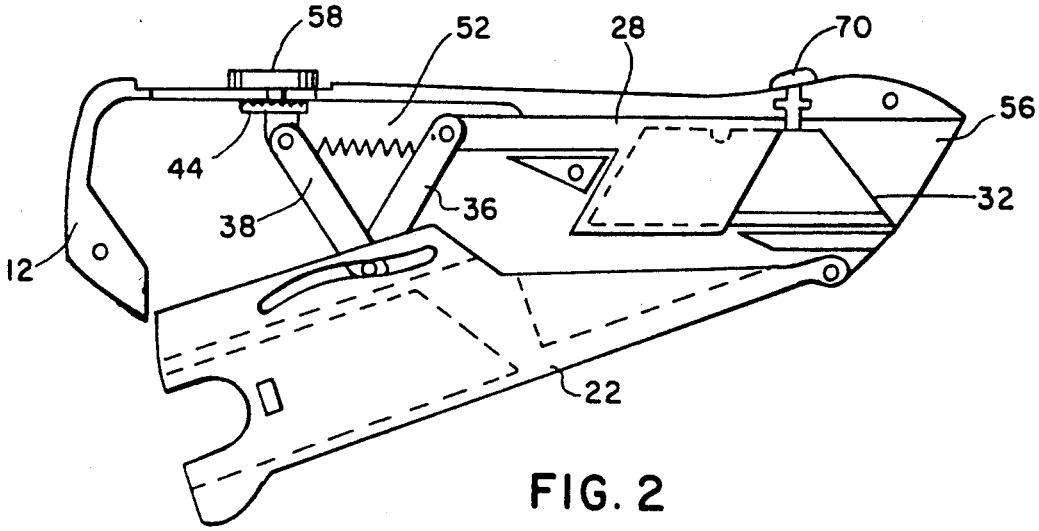
FIG. 2 is simplified sectional view thereof, taken on a vertical plane from the right side of the knife.
Figure 7:
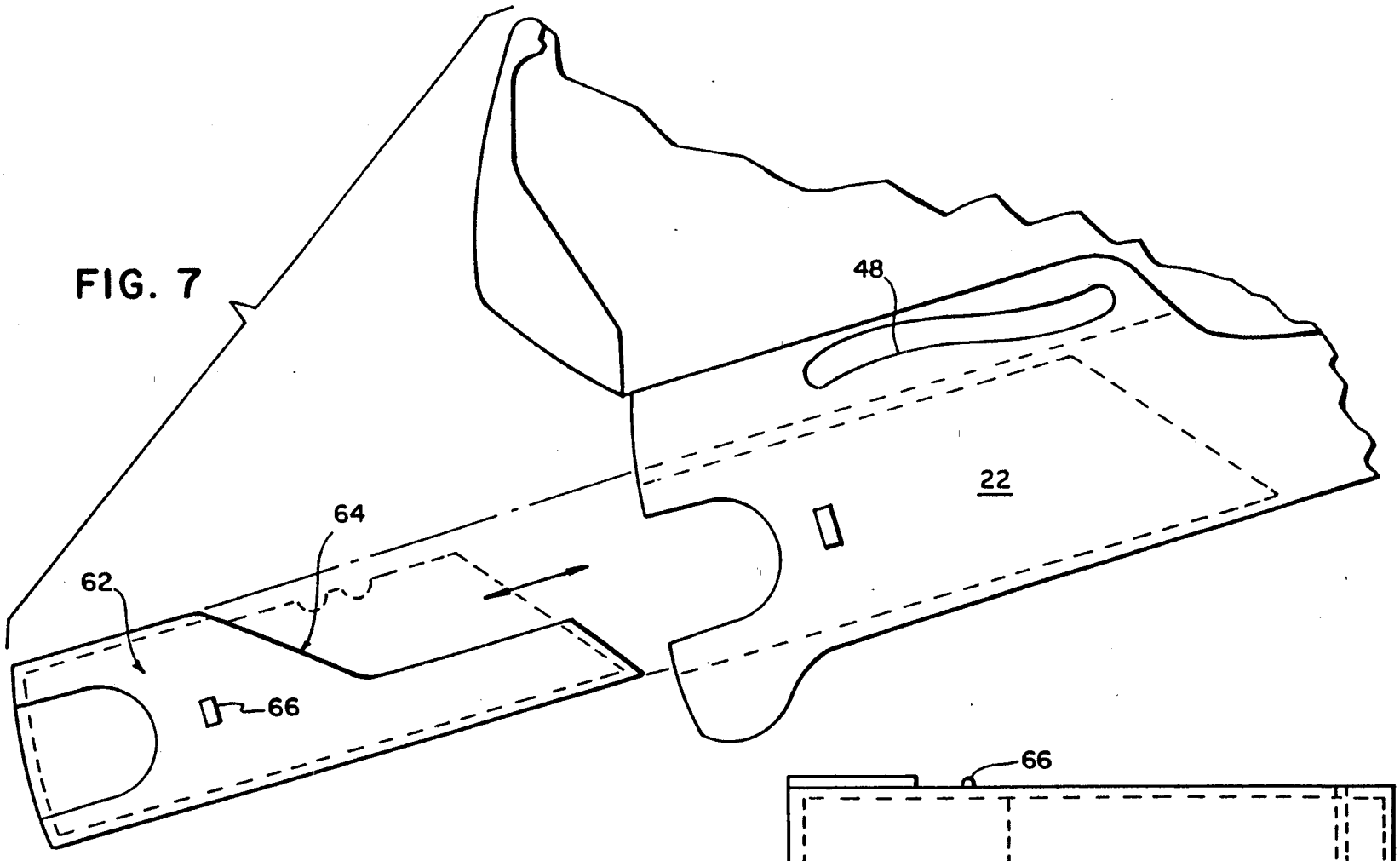
FIG. 7 is an enlarged exploded detail of a portion of the operating lever and a blade magazine which fits inside the lever.
Figure 8:
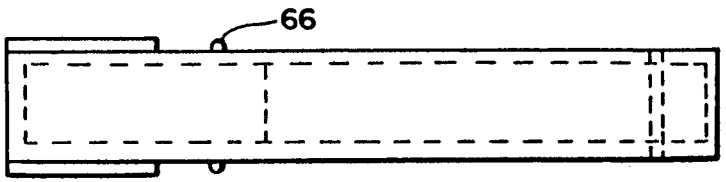
FIG. 8 is a bottom elevation of the magazine alone.

A utility knife embodying the invention is shown in FIGS. 1-2. The knife comprises a hollow handle 10 formed in left and right halves 12 and 14, which are held together by screws 16 which pass through holes 18 in the left half into threaded holes 20 in the right half. An operating lever 22, shown in detail in FIGS. 7-8, is supported on a pin 24 whose ends are supported in opposed holes near the front 26 of the handle. A blade holder 28, shown in detail in FIGS. 5 and 6, is slidably supported in recesses 30 at the front of the handle. A conventional utility knife blade 32 is held snugly by the blade holder, so that it can be easily replaced with a sharp blade when necessary.

Figure 3:
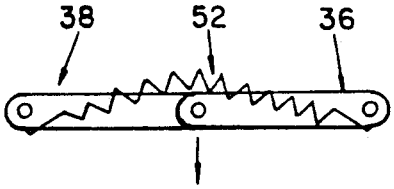
FIG. 3 is a detail of a toggle linkage shown in FIG. 2.

The blade is moved fore and aft in its recess by a toggle linkage comprising two links 36,38 (see detail of FIG. 3) connected at the front by a pin 40 to the blade holder, at the rear by a pin 42 to an adjustable, but stationary, mount 44 near the rear of the handle. The links 36,38 are interconnected by a central hinge pin 46 which has a greater width than the other two pins, so that its ends extend into respective like slots 48 in either wall 50 of the operating lever.

Figure 9:
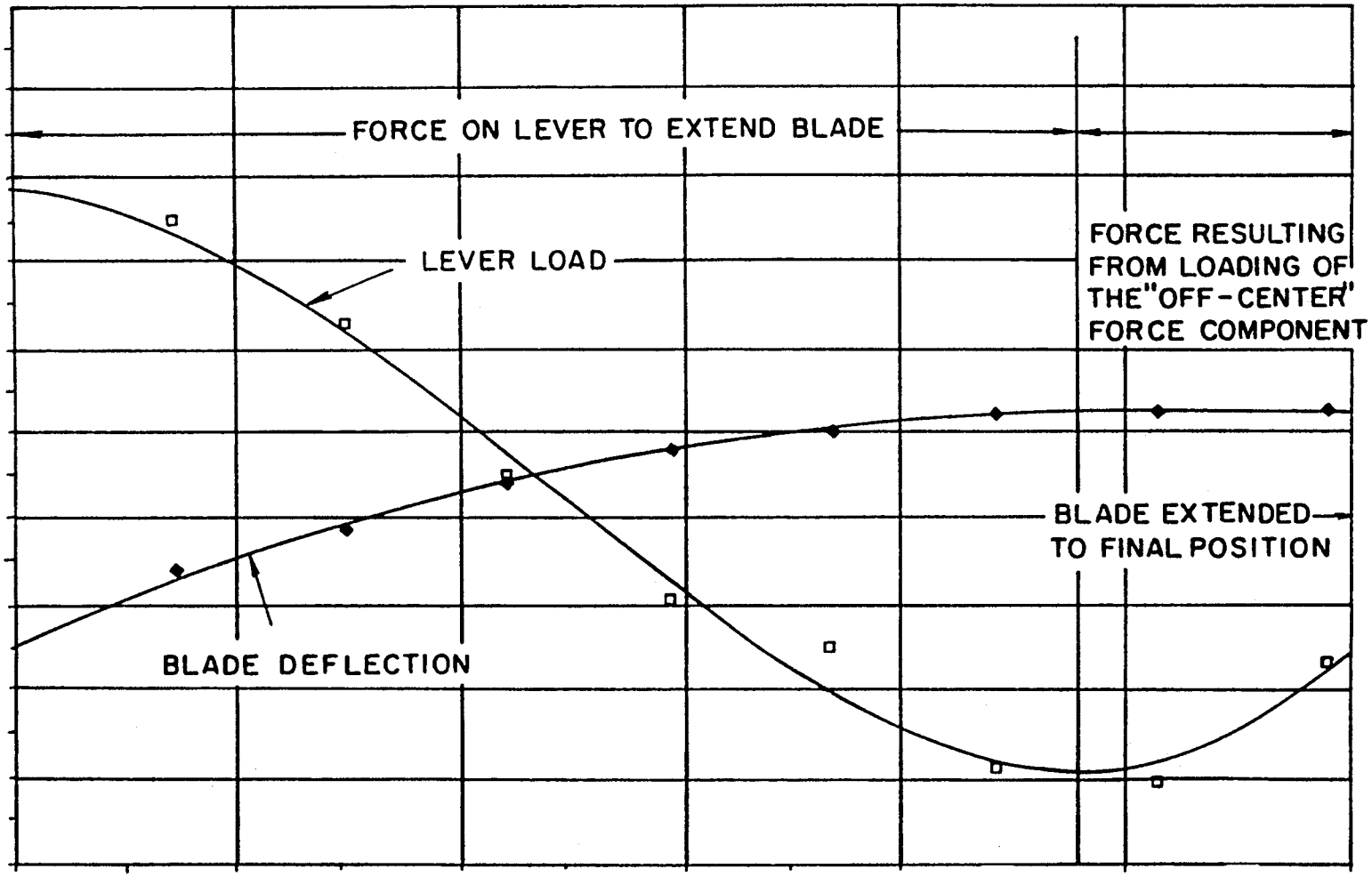
FIG. 9 is a diagram representing typical lever loading and blade extension as a function of lever movement.

The front and rear pins are drawn together by a coil spring 52 in tension, so that the blade is normally (FIG. 2) retracted to a safe position totally within the handle. In this position, the operating lever is pivoted downward, out of the opening 54 at the bottom of the handle. When the lever is squeezed, however, so that it enters the cavity, the hinge pin of the toggle linkage straightens the links, forcing the blade out of the forward opening 56 of the handle. The increasing mechanical advantage of a toggle linkage, despite increasing spring tension as the lever extends, results in a generally decreasing force diagram, shown in FIG. 9. The units of the graph should be regarded as abitrary, since actual magnitudes will vary with the dimensions of the parts.

How far the blade protrudes from the handle, in the linkage's fully distended position, is determined by the position of the stationary mount at the rear of the linkage. This position can be adjusted can be adjusted by loosening the thumbscrew 58, whose head protrudes from a slot 60 at the top of the handle, and sliding the screw forward or rearward to achieve the desired blade exposure, before retightening the screw to draw the toothed upper surface of the mount 44 against the top of the handle cavity. FIG. 5 shows the blade substantially extended, while FIG. 6 illustrates the toggle support adjusted fully rearward to keep the blade from protruding at all from the knife housing. Nevertheless, we prefer to provide a safety button 70 as well, at the nose of the knife. The safety button is disposed within the recess 73 when the button 70 is in a non-blocking position and may be moved laterally into the forward opening 56 of the handle for blocking the front end of the blade holder, preventing it from extending.

Figure 4:
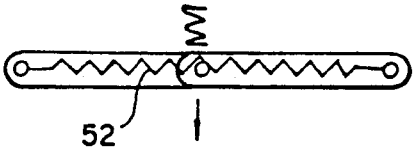
FIG. 4 is a detail of a modified form of the toggle linkage.

The toggle linkage is biased away from its fully distended position, preferably (FIG. 3) by passing the spring over the hinge pin, so that it follows a curved line in the blade-extended position, and thus applies a downward force component on the hinge pin. Alternatively (FIG. 4), a small auxiliary spring may be placed along a line perpendicular to the main spring, biasing the hinge pin, or either link of the toggle, downward. The auxiliary spring, if used, need not be a coil spring; it could be instead a torsion spring, or a cantilever spring associated with one of the links. Any of the above alternatives account for the slight "tail" on the lever loading force curve shown in FIG. 9.

The hinge pin slot shown is arcuate, following an "S" path which has been designed to keep the normal force vector between the pin and the slot at a substantial angle to the length of both links during operation. Should the normal force vector become aligned with one of the links, a large or infinite force would have to be applied to the operating lever in order to move the blade. Thus, the path shape shown provides better feel by avoiding "hard" spots in the lever travel. Depending on the dimensions of the toggle links and other components, a differently shaped slot, even a straight slot, may prove workable.

FIGS. 1, 7 and 8 show a blade clip 62 having a forwardly open pocket 64, capable of holding additional blades, which is inserted into the opening at the rear of the operating lever. The clip has tabs or detents 66 which enable it to snap in and out of its seated position in the lever.

Since the invention is subject to modifications and variations, it is intended that the foregoing description and the accompanying drawings shall be interpreted as illustrative of only one form of the invention, whose scope is to be measured by the following claims.

We claim as our invention:

1. A safety utility knife comprising a handle having a cavity with a forward opening and a bottom opening, an operating lever pivotally mounted to the handle and movable with respect to the handle within said bottom opening, a blade holder slidably mounted within said forward opening, a removable blade supported by the blade holder, a toggle linkage including a pair of links, one of which is connected to the handle by a rearmost pin, the other of which is connected by a foremost pin to the blade holder, the links being interconnected by an intermediate hinge pin which is engaged in a groove in the operating lever, and a spring biasing the blade holder rearward in the handle, the improvement, in combination therewith, comprising a discrete mount connected to said one link by said rearmost pin, said mount being slidably mounted within said handle, and having an adjustable but normally fixed position within the handle, and a threaded fastener engaged in said mount and protruding through an opening in the handle, whereby one can manually adjust and lock the position of said mount from outside the handle, thereby adjusting how far the blade protrudes from the forward opening when the lever is depressed toward the bottom opening of the handle.

2. The safety utility knife of claim 1, wherein the fastener is a screw having a head outside the handle and the mount has a thread for receiving the screw, so that the screw can be tightened to fix the mount's position within the handle, and the position of said mount is continuously adjustable within a range of positions.

3. The safety utility knife of claim 2, wherein said handle has a lengthwise slot and said fastener is a thumbscrew having a head outside said handle and a threaded portion extending through said slot into said mount, whereby the mount can be moved within the handle by loosening the thumbscrew, moving the thumbscrew to another position, and retightening the thumbscrew.

4. The safety utility knife, wherein said slot is formed in an upper surface of the handle, and extends along a vertical plane bisecting the handle.

5. The safety utility knife of claim 4, wherein the handle is formed in two complementary halves lying an opposite sides of said vertical plane.

6. The safety utility knife of claim 1, wherein said spring is a tension spring strung between said foremost and rearmost pins.

7. The safety utility knife of claim 6, wherein said spring is passed over said hinge pin, to prevent the toggle linkage from tending to remain in its fully distended position.

8. The safety utility knife of claim 1, wherein said operating lever is hollow and contains a snap-in holder adapted to contain replacement blades.

9. The safety utility knife of claim 1, wherein the groove in the operating lever follows an arcuate path designed so that, at every position of the lever, neither of said links is aligned with a line normal to said groove at its point of contact with said pins.

10. The safety utility knife of claim 1, wherein the handle has a laterally extending recess proximate its forward opening, and further comprising a safety element laterally slidable in the recess between a position blocking extension of said blade holder and a position permitting extension of said blade holder past said safety element.

* * * * *